US006547171B1

(12) United States Patent
Fontanille

(10) Patent No.: US 6,547,171 B1
(45) Date of Patent: Apr. 15, 2003

(54) PULVERIZING INSTALLATION

(75) Inventor: Daniel Fontanille, Hermeray (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/959,721

(22) PCT Filed: May 4, 2000

(86) PCT No.: PCT/FR00/01202

§ 371 (c)(1),
(2), (4) Date: Nov. 6, 2001

(87) PCT Pub. No.: WO00/67910

PCT Pub. Date: Nov. 16, 2000

(30) Foreign Application Priority Data

May 7, 1999 (FR) ..... 99 05832

(51) Int. Cl.[7] ..... B02C 17/00
(52) U.S. Cl. ..... 241/52; 241/57; 241/79.1; 241/171; 241/174
(58) Field of Search ..... 241/47, 52, 57, 241/79.1, 171, 174

(56) References Cited

U.S. PATENT DOCUMENTS

| | | | | |
|---|---|---|---|---|
| 926,441 A | * | 6/1909 | Shafter | 241/172 |
| 927,054 A | * | 7/1909 | Knecht | 241/54 |
| 931,045 A | * | 8/1909 | Emerick | 241/171 |
| 1,719,971 A | * | 7/1929 | Fahland | 241/171 |
| 2,174,630 A | * | 10/1939 | Hardinge | 241/49 |
| 2,285,429 A | | 6/1942 | Frisch | |
| 5,873,532 A | | 2/1999 | Fontanille | |

FOREIGN PATENT DOCUMENTS

| | | |
|---|---|---|
| DE | 590 792 C | 1/1934 |
| EP | 0 234 017 A | 9/1987 |

OTHER PUBLICATIONS

Patent Abstracts of Japan, vol. 017, No. 533, Sep. 27, 1993 & JP 05 146697 A (Mitsubishi Heavy Ind Ltd), Jun. 15, 1993 *Abstract* .

* cited by examiner

*Primary Examiner*—John M. Husar
(74) *Attorney, Agent, or Firm*—Sughrue Mion, PLLC

(57) ABSTRACT

The ball mill is of the type including:

Figure 1:
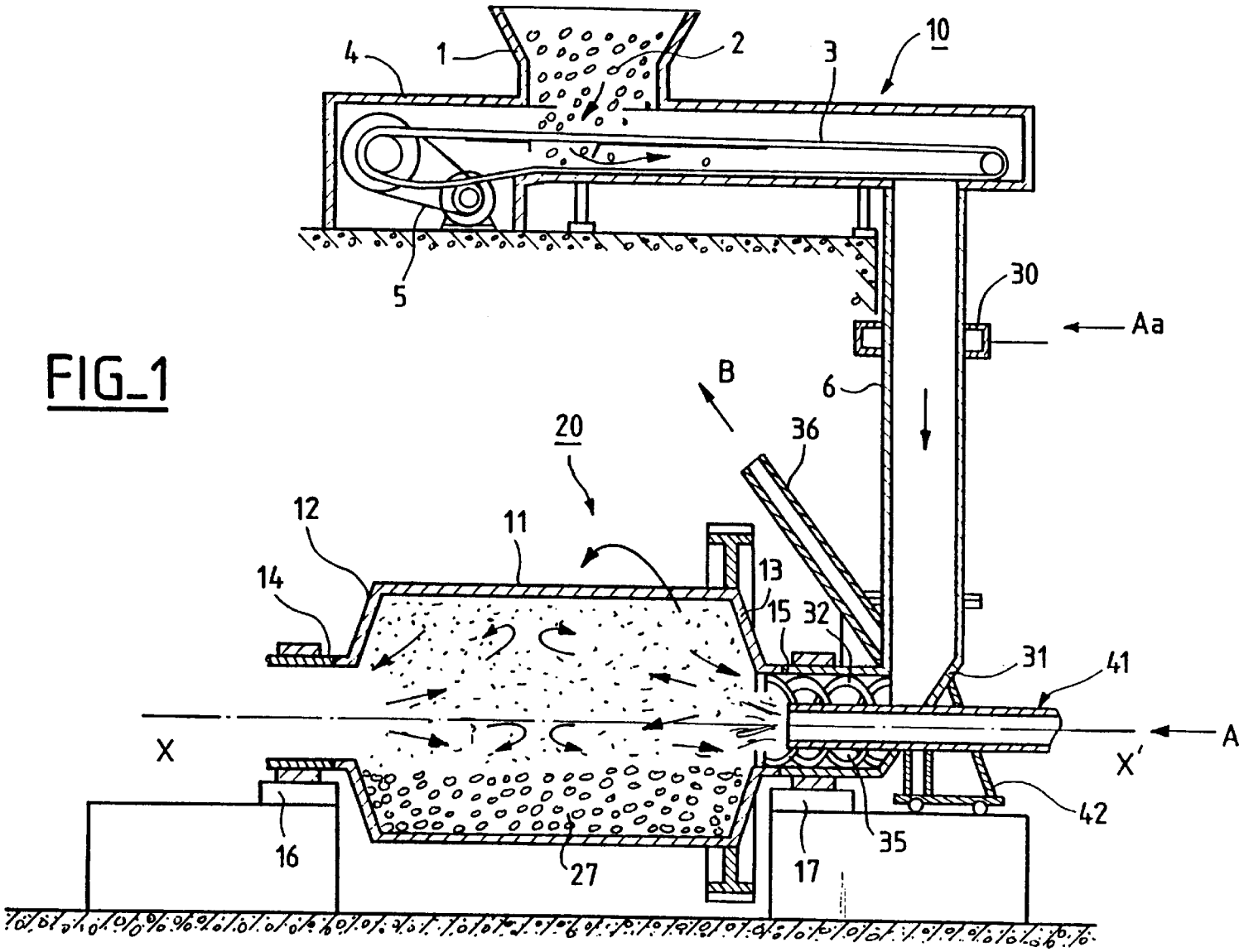

a rotary drum (11, 12, 13) having a horizontal axis (XX') and each end of which is supported by a journal (14, 15) which terminates it and through which passes an axial tube (41) around which it delimits an annular duct (35), a vertical pipe (6) discharging in the vicinity of the journal at the level of a guide member (31) for directing material to be pulverized from the pipe towards the drum, and an outlet duct (36) communicating with the annular duct for ejecting from the drum the mixture consisting of the gas and the pulverized material. Each journal contains a rigid helicoidal Archimedes screw structure (32) fixed to it and turning with it about the tube, when the drum rotates, which tube is a rigid immobile gas injector tube.

8 Claims, 2 Drawing Sheets

PULVERIZING INSTALLATION

The invention relates to a pulverizing installation comprising a ball mill including a rotary drum having a horizontal axis and each end of which comprises a journal resting on a bearing, the mill being fed with material to be pulverized and with gas via at least one of its ends by means of a feed device comprising a feed pipe for feeding with material to be pulverized, a rigid gas injector tube passing axially through the corresponding journal, said rigid tube and said journal defining therebetween an annular duct, said feed pipe discharging into said annular duct in the vicinity of the corresponding journal, said journal containing a rigid helicoidal Archimedes screw structure disposed about said rigid gas injector tube, said rigid helicoidal structure turning with the drum when it drum rotates in order to feed the material to be pulverized towards the interior of the rotary drum, an outlet duct communicating with said annular duct for ejecting the mixture constituted by the gas and by the material pulverized in the form of powder out of the drum.

Such installations are used in particular to pulverize solid fuels to feed them in pulverized form to the burners of boilers. The balls, or equivalent other pulverizing members, which are made from a hard material, pulverize the material by crushing, grinding, and/or attrition. The material is introduced into the rotary drum in the form of particles of varying coarseness via the journals which support the drum at its ends. The pulverized material is carried out of the drum by means of a gas. The gas is introduced into the drum of the ball mill via the journals at the same time as the material to be pulverized and follows a circuit enabling it to leave the drum. The gas used is generally air. It is fed into the drum either via one of the journals, leaving via the other journal charged with the powder material, or symmetrically via each of the two journals, through which it also exits in a contra-flow configuration with the pulverized material by virtue of the presence of deflector members.

If the material to be pulverized is damp, the injected gas is heated. It then dries the pulverized material it conveys. The pulverized material generally has a relatively wide range of particle sizes and it is known in the art to pass it through a separator which lets through only the fine grains of the material and recycles the coarse grains back into the drum.

Document U.S. Pat. No. 2,285,429 describes a pulverizing installation as defined above. In the installation described, the gas for conveying the pulverized material is fed in through a journal by means of a hollow tube carrying the Archimedes screw and coaxial with and inside the journal. The hollow tube is fixed by a system of bars to the interior of the drum of the ball mill and rotates on its axis with the drum. As a result, at least some parts of the system of bars are subject to the impact of the moving balls as the drum turns. The hollow tube is supported by a bearing which must be sealed against the dust conveyed by the charged gas and it must be continuously cooled if the gas has previously been heated for the purpose of drying the material.

The installation in a journal of the drum of a tube fixed to the drum and to an end bearing does not facilitate access to the parts of the ball mill subject to wear, in particular the balls, the Archimedes screw and the bars supporting the hollow tube. It is then necessary to demount other parts of the ball mill to obtain access to the above parts that are subject to wear, a particular consequence of which is to increase the maintenance and down times of the ball mill.

The object of the present invention is to mitigate those drawbacks and to propose a pulverizing installation as defined above, the installation being characterized in that said feed pipe for feeding material to be pulverized is substantially vertical and discharges into said annular duct at the level of a guide member for directing the material to be pulverized as conveyed by the pipe towards the drum, in that said rigid gas injector tube is held immobile and penetrates into the journal by passing through said guide member from the outside, and in that said rigid helicoidal structure is fixed to the journal.

The injector tube axially introduced into the journal at one end of the drum is mounted on an immobilizing frame which can be moved relative to the drum.

The invention, its features, and its advantages are explained in the following description, which is given with reference to the figures listed below.

FIG. 1 is view in longitudinal section of a coal pulverizing installation.

Figure 3:
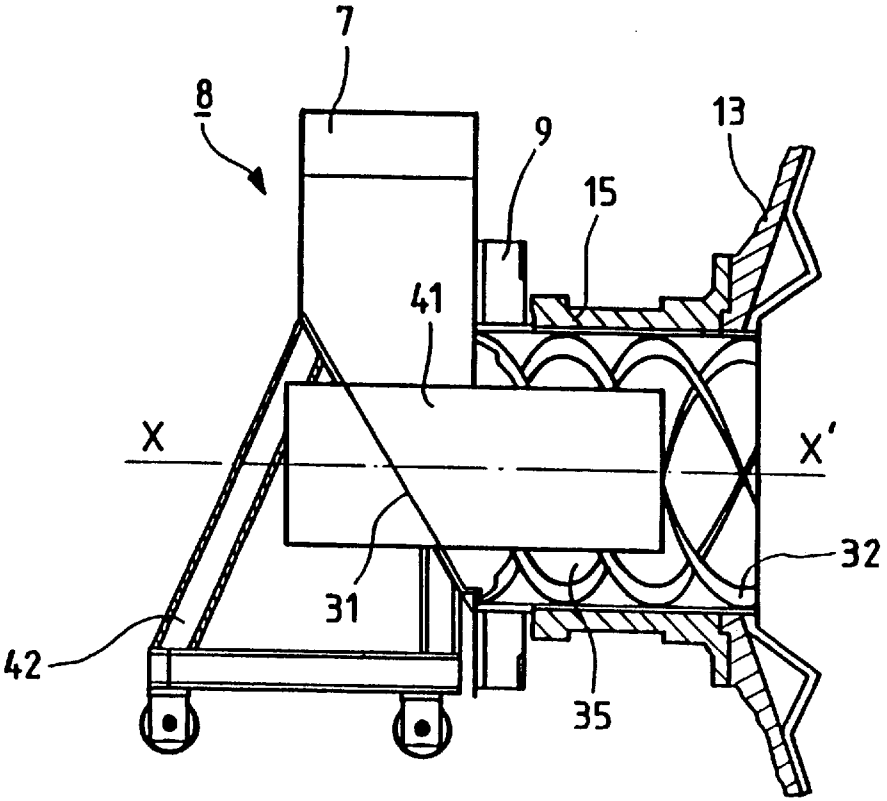
Figure 2:
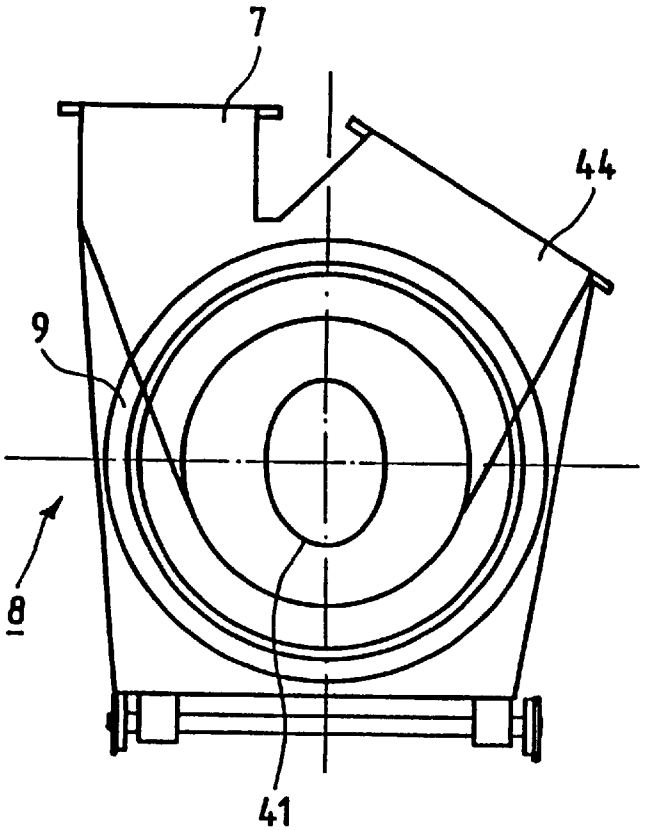

FIGS. 2 and 3 respectively a diagrammatic end view and a diagrammatic longitudinal sectional view of a ball mill end connector in accordance with the invention.

The pulverizing installation shown by way of example in FIG. 1 includes a device 10 for feeding material to be pulverized and a ball mill 20 fed by the feed device, the material to be treated being cold, for example.

The device 10 has a storage hopper 1 for feeding particles to a chain conveyor 3, which particles constitute the material to be pulverized. The conveyor is inside a box-section 4 and it is driven by a motor 5. It feeds the particles to be pulverized to the top end of a vertical or substantially vertical pipe 6 into which the particles drop.

The ball mill 20 includes a rotary drum whose axis of rotation is horizontal or substantially horizontal. The drum has a circular cylindrical part 11 extended at each end by a conical part 12, 13 to which respective journals 14, 15 are fixed supporting the drum. Each of the two journals is supported by a respective bearing 16, 17. The drum is driven in rotation by a motor and gear box unit, not shown, and is filled with balls 27 made of a hard material, for example steel, or with functionally equivalent hard members.

The installation is preferably symmetrical, in particular with regard to the arrangements at the two ends of the ball mill which are described below and which include the vertical pipe 6 feeding the material to be pulverized. As indicated above, the particles of material to be pulverized drop into each pipe 6 which discharges near an end of the drum where a journal such as the journal 15 is mounted. To this end the lower end of each pipe is connected to a coupling member 7 of an end connector 8 which is connected to the drum at the end of a journal such as the journal 15 via a coupling member 9 and a rotary seal, these components being shown more particularly in FIGS. 2 and 3. The particles of the material to be pulverized which drop into a pipe such as the pipe 6 are directed towards the drum by a guide member 31 which takes the form of an inclined plate, for example. Here this member is a wall of the connector 8, possibly a removable wall, located under the lower end of the pipe, facing the opening in the journal on the axis of the drum and obliquely oriented relative to the respective longitudinal axes of the pipe and the drum.

A rigid gas injector tube 41 passes through the connector and is aligned with a longitudinal axis XX' of the journal in which it is located when the connector is fitted to the ball mill, as shown in FIGS. 1 and 3. In the embodiment shown, the tube 41 is a rectilinear tube with an elliptical cross-section whose major axis is preferably vertical. It passes through the wall that constitutes the guide member 31 to enable the gas for conveying the pulverized material to be injected into the drum from outside, as symbolized by the arrow A.

According to the invention, the tube 41 is mounted on an immobilizing frame 42 which is mobile relative to the drum to insert the tube into the journal 15 and to withdraw it therefrom. In a preferred embodiment of the invention, the connector 8 and the tube 41 are carried by the frame 42, which moves them relative to the drum to position the connector relative to the journal, to which it is connected via a rotary seal.

Here the frame 42 is mounted on wheels. It is used to move the assembly comprising the tube and the connector before it is immobilized in the required position in the installation, facing one of the journals of the drum. It can also be moved in the opposite direction to expose the axial opening of the journal and of the drum completely.

The length of the tube portion 41 that passes through a journal 15 is preferably chosen so that the end of the tube does not enter the area inside the drum in which the balls and the particles of material to be pulverized move when the drum rotates. The extent to which the tube 41 penetrates into the journal is therefore limited so that the end of the tube through which the gas is injected into the drum remains within the journal, set back slightly relative to the main body of the drum.

The dimensions of the tube 41 are chosen so that an annular duct 35 is formed between its outside wall and the inside wall of the journal into which the tube is axially inserted. The annular duct conveys the particles of the material to be pulverized, which are directed towards the interior of the drum by a guide member 31. A helicoidal Archimedes screw structure 32 turns about the tube 41 with the journal 15 when the drum rotates. It directs into the drum particles deflected by the guide member and moving along the outside of the tube 41. In the intended application, the structure is preferably rigid and hard, so as to resist friction and the thrust of the particles of the material to be pulverized.

In the proposed embodiment, the annular duct 35 also conveys the mixture consisting of the gas and the pulverized material in the opposite direction to the particles of the material to be pulverized. This contraflow of the material to be pulverized and the pulverized material is possible because the blades of the helicoidal structure 32 are sufficiently spaced from the tube 41, as can be seen in FIG. 3. The mixture ejected from the drum is passed via the annular duct and the connector 8 to an outlet duct 36 connected to a coupling member 44 of the connector. The mixture consisting of the gas and the pulverized material is symbolized here by the arrow B and is fed to a boiler as fuel, for example.

In the proposed embodiment, the end connector of the drum includes coupling members for the connections to the vertical pipe and the outlet duct. The respective axes of these coupling members are in a common plane which is perpendicular to the axis of the gas injector tube which passes through the connector at the level of the guide member, which here takes the form of a plate oblique to the axis of the tube and to that of the coupling member of the vertical pipe.

An additional gas inlet can be provided for feeding a drying box 30 at the top of the vertical pipe 6 to help with drying the material to be pulverized. The respective gas flowrates Aa via the box 30 and A via the tubes 41 at each end of the drum are then controlled in a coordinated manner to optimize the flowrate of the mixture B at the exit from the duct 36.

What is claimed is:

1. A pulverizing installation comprising a ball mill including a rotary drum (11, 12, 13) having a horizontal axis (XX') and each end of which comprises a journal (14, 15) resting on a bearing (16, 17), the mill being fed with material to be pulverized and with gas via at least one of its ends by means of a feed device comprising a feed pipe (6) for feeding with material to be pulverized, a rigid gas injector tube (41) passing axially through the corresponding journal (14, 15), said rigid tube (41) and said journal (14, 15) defining therebetween an annular duct (35), said feed pipe (6) discharging into said annular duct (35) in the vicinity of the corresponding journal (14, 15), said journal (14, 15) containing a rigid helicoidal Archimedes screw structure (32) disposed about said rigid gas injector tube (41), said rigid helicoidal structure (32) turning with the drum when it drum rotates in order to feed the material to be pulverized towards the interior of the rotary drum (11, 12, 13), an outlet duct (36) communicating with said annular duct (35) for ejecting the mixture constituted by the gas and by the material pulverized in the form of powder, out of the drum, the installation being characterized in that said feed pipe (6) for feeding material to be pulverized is substantially vertical and discharges into said annular duct (35) at the level of a guide member (31) for directing the material to be pulverized as conveyed by the pipe (6) towards the drum, in that said rigid gas injector tube (41) is held immobile and penetrates into the journal (14, 15) by passing through said guide member (31) from the outside, and in that said rigid helicoidal structure (32) is fixed to the journal (14, 15).

2. An installation according to claim 1, wherein the rigid gas injector tube (41) is mounted on an immobilizing frame (42).

3. An installation according to claim 2, wherein the rigid gas injector tube (41) and said guide member (31) are mounted on the same immobilizing frame.

4. An installation according to claim 3, wherein the tube (41) and the guide member (31) at one end of the drum and carried by the same immobilizing frame (42) are incorporated into an end connector (8) of the drum which is butted against that end of the drum and butt-jointed to the respective ends of said vertical pipe (6) and said outlet duct (36).

5. An installation according to claim 4, wherein said guide member (31) takes the form of a plate disposed obliquely to the axes of the tube (41) and the coupling member of the vertical pipe (6), and the end connector (8) of the drum includes coupling members (7, 44) for connecting it to the vertical pipe (6) and to the outlet duct (36) and whose respective axes are in a common plane through said connector and perpendicular to the axis (XX') of the gas injector tube (41).

6. An installation according to claim 4, characterized in that said connector (8) comprising said frame (42), the rigid gas injector tube (41), and said guide member (31) is displaceable and is connected to the journal (14, 15) via a coupling member (9) and a rotary seal.

7. An installation according to claim 1, wherein the gas injector tube (41) mounted at one end of the drum discharges into the drum at a location which is set back inside the journal relative to the main part of the drum.

8. An installation according to claim 1, wherein each vertical pipe (6) includes a pre-dryer box (30) for introducing an additional hot gas into the pipe.

* * * * *